US005329833A

United States Patent [19]

Sergan

[11] Patent Number: 5,329,833

[45] Date of Patent: Jul. 19, 1994

[54] BIMODAL HYDRAULIC RECIPROCATING TORQUE ACTUATOR

[76] Inventor: Anthony J. Sergan, 22 Ellen Dr., Farmington, Conn. 06032

[21] Appl. No.: 923,301

[22] Filed: Jul. 31, 1992

[51] Int. Cl.[5] ..... B25B 13/46

[52] U.S. Cl. ..... 81/57.39; 81/62

[58] Field of Search ..... 81/60–63, 81/57.39

[56] References Cited

U.S. PATENT DOCUMENTS

| | | | |
|---|---|---|---|
| 2,729,997 | 1/1956 | Davis . | |
| 2,890,612 | 6/1959 | Sergan | 81/62 X |
| 2,961,904 | 11/1960 | Sergan . | |
| 3,372,611 | 3/1968 | Amanti et al. . | |
| 3,604,292 | 9/1971 | Sada . | |
| 3,686,983 | 8/1972 | Flagge . | |
| 3,759,119 | 9/1973 | Wing . | |
| 5,005,447 | 4/1991 | Junkers . | |

*Primary Examiner*—D. S. Meislin

*Attorney, Agent, or Firm*—St. Onge Steward Johnston & Reens

[57] ABSTRACT

The invention presented relates to an apparatus for applying rotational force to a workpiece. In general, this inventive apparatus includes a cylindrical driving member which has an opening sized to engage a workpiece on which rotational force is to be applied; a first outer cylindrical member disposed concentrically about the driving member and in a ratcheting relationship thereto, such that rotation of said first outer cylindrical member in a first direction will cause the driving member to rotate in the first direction, and rotation of the first outer cylindrical member in a second direction will not cause the driving member to rotate in the second direction; and a second outer cylindrical member disposed concentrically about the driving member and in a ratcheting relationship thereto such that rotation of the second outer cylindrical member in a first direction will cause rotation of the driving member in the first rotation and rotation of the second outer cylindrical member in a second direction will not cause rotation of the driving member in the second direction. The first and said second outer cylindrical members can be drivingly rotated in either of a first or a second direction in series to apply relatively continuous rotational force to the driving member or in parallel to apply intermittent yet higher powered force to the driving member.

24 Claims, 11 Drawing Sheets

FIG. 15bb
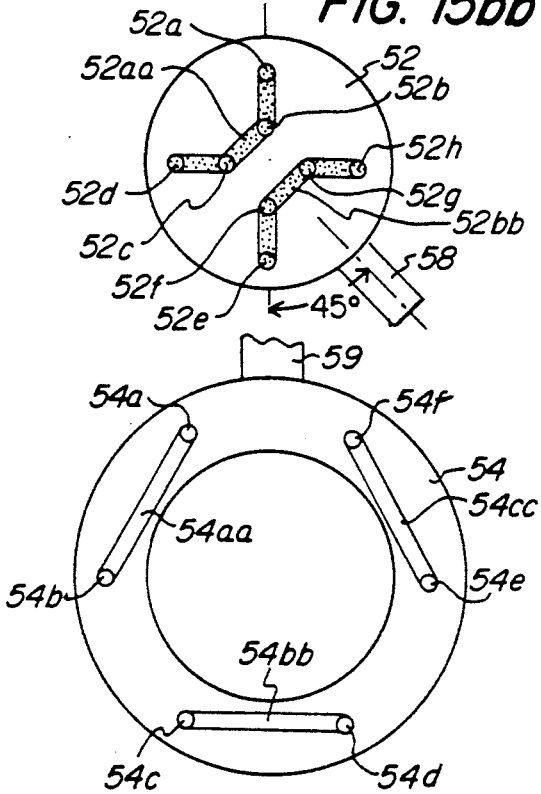
FIG. 16bb
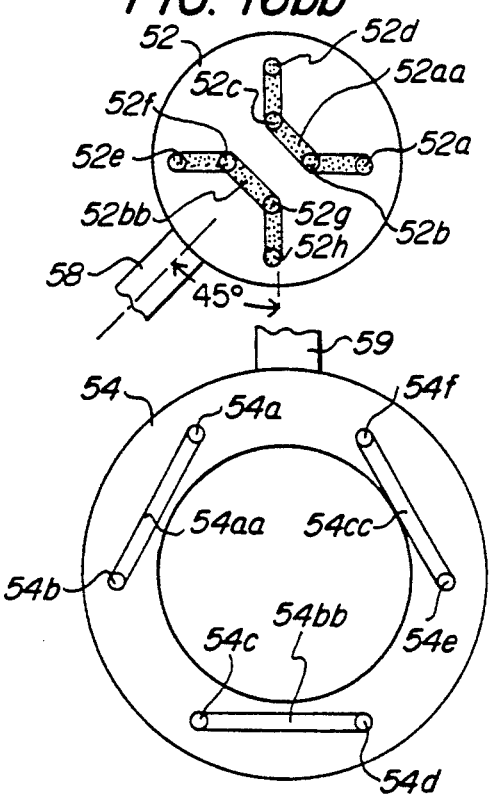
FIG. 15aa
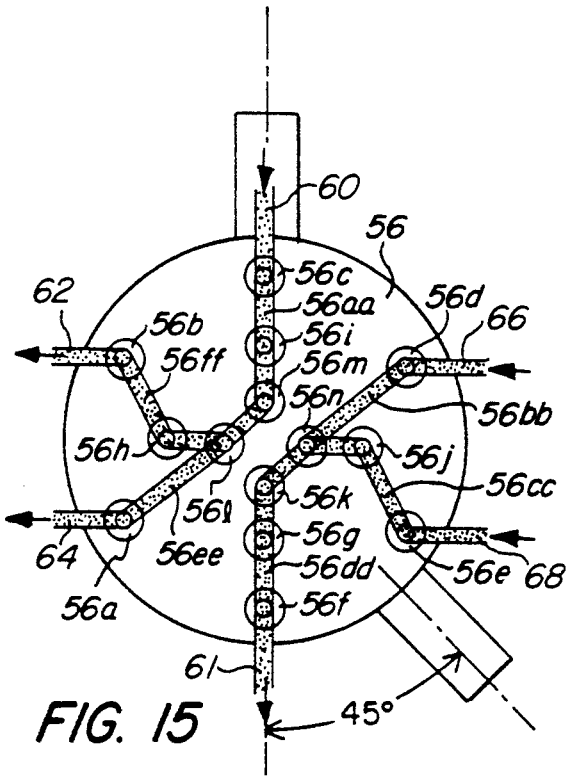
FIG. 15
FIG. 16aa
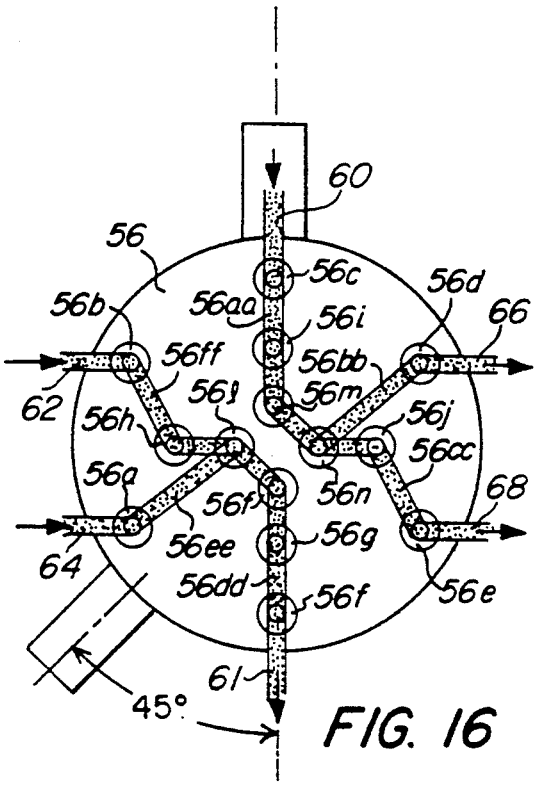
FIG. 16

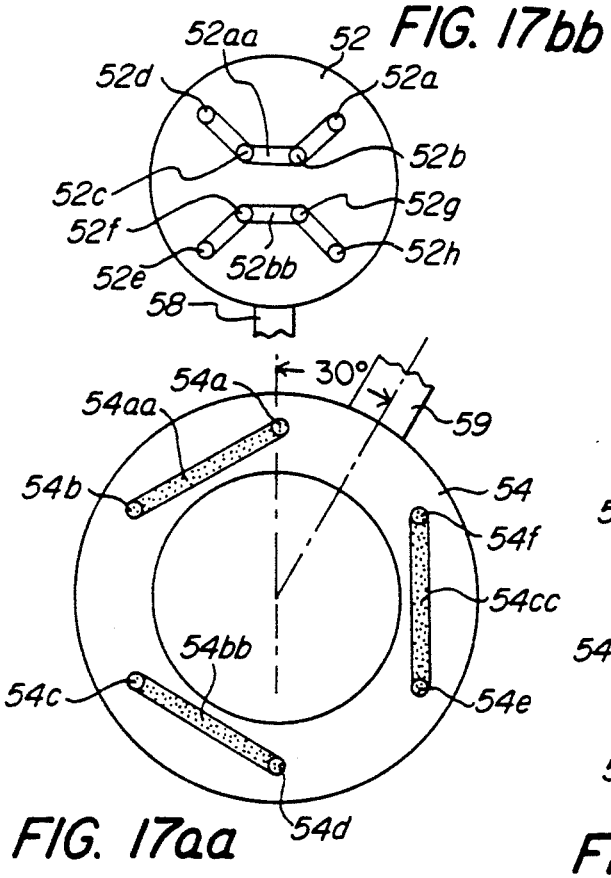
FIG. 17bb
FIG. 17aa
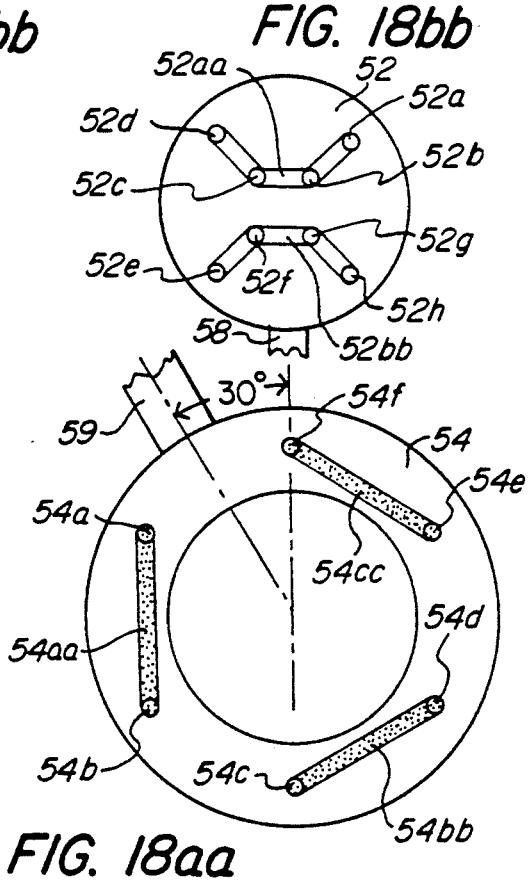
FIG. 18bb
FIG. 18aa
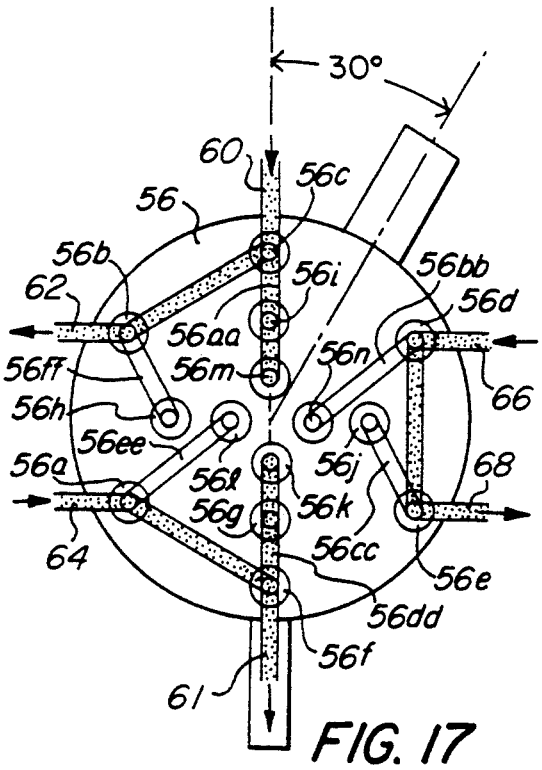
FIG. 17
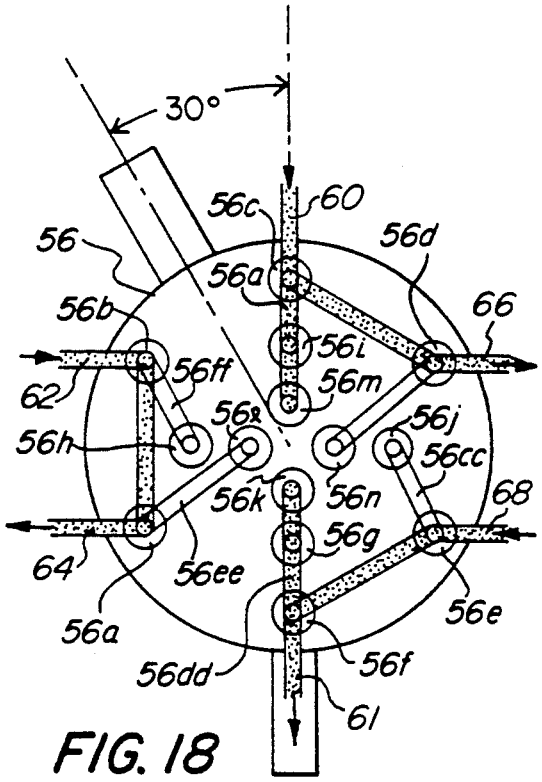
FIG. 18

BIMODAL HYDRAULIC RECIPROCATING TORQUE ACTUATOR

FIELD OF THE INVENTION

The present invention relates to a hydraulic push-pull reciprocating torque actuator, more specifically a hydraulic torque wrench, which is operable in either one of two operational modes, in a clockwise or counterclockwise direction.

BACKGROUND OF THE INVENTION

Hydraulic torque wrenches are precision tools which are used to torque and untorque assemblies to a high degree of accuracy. This can be extremely important in applications such as a gas turbine engine and an aircraft frame. These applications require central balanced torque, to eliminate friction and side loading effects as are found in some hydraulic and/or mechanical type wrenches using an offset, inaccurate torquing method. It is critical when assembling such devices that a highly accurate amount of torque is applied to bolts and other types of threaded connectors to ensure the structural security of the connection made. However, since standard torque wrenches are not sufficient for applying the required amount of torque, hydraulic torque wrenches were developed. Other applications in which hydraulic torque wrenches are commonly employed are in driving winches, spring winding apparatus, pipe die threading, and the fastening of various devices such as nuts and bolts.

Commonly, hydraulically actuated torque wrenches comprise a cylindrical member having an opening sized and shaped to engage a workpiece, such as a socket or the head of a bolt or other threaded connector, and apply torque (i.e., rotational force) thereto. Most often, the opening is splined to facilitate engagement of the workpiece. The cylindrical member is fitted with at least one and most commonly a plurality of studs which extend therefrom. These studs are equidistant from the actuator center line, and are acted upon by the action of a hydraulically driven piston and cylinder arrangement to controllably rotate the cylindrical member, which thereby applies accurate output torque to a workpiece engaged by the opening.

Most commonly, the cylindrical member having the opening which accommodates the workpiece is disposed within a second, larger cylindrical member from which depend the stud or studs. In this way, a ratcheting relationship between the inner cylindrical member and the outer cylindrical member can be provided. In so doing, it would not be necessary to disengage the hydraulic cylinders from the outer cylindrical member studs to continue rotation of the inner cylindrical member in a first direction. Rather, the push-pull hydraulic cylinders can reverse direction and return to their starting point without applying torque or untorque forces to the workpiece, because the ratcheting relationship between the inner cylindrical member and the outer cylindrical member keeps the inner cylindrical member stationary while the outer cylindrical member is rotated back to its initial position. Because of this ratcheting action, however, torque applied to a workpiece is applied in an intermittent fashion, because there is no torque being applied as the hydraulic pistons (and thereby the outer cylindrical member) are returning to their original position.

It would be desirable to provide an apparatus and method capable of efficiently providing substantially continuous torque to a workpiece in a first mode and applying intermittent yet increased power torque to the workpiece in a second mode.

SUMMARY OF THE INVENTION

It is an object of the invention to provide an apparatus for and method of applying precision torque (i.e., rotational force) to a workpiece in either a continuous or intermittent yet high powered manner. It is an object of the invention to provide such an apparatus and method to apply continuous or intermittent yet high powered torque to a workpiece in a device which is of a size and portability normally associated with hydraulic torque wrenches. It is another object of the present invention to provide a coaxial valving system capable of adjusting the operation of a hydraulic torque wrench between rotational direction (generally referred to as clockwise or counterclockwise) and continuous and intermittent modes of operation.

These objects and others as set forth herein are provided by an apparatus and method for applying rotational force to a workpiece in accordance with the invention, generally comprising a cylindrical driving member having an opening sized to receive a workpiece, the driving member being disposed within and in a ratcheting relationship to each of a first and second outer cylindrical member. Each of the first and a second outer cylindrical members are concentrically disposed about the driving member, and are independently hydraulically driven.

The first and second outer cylindrical members are each independently driven by the action of hydraulic piston and cylinder arrangements on at least one stud extending from each of the first and second outer cylindrical members. Each of the outer cylindrical members is driven by the action of two pairs of hydraulic piston and cylinder arrangements which cooperate to rotate each of the first and second outer cylindrical members through an arc of about 44°, and then return them to their original or starting position. This cyclic rotation of the first and second outer cylindrical members is then repeated. Because of the ratcheting relationship between the first and second outer cylindrical members and the driving member, this repetitive cycling of the hydraulic piston and cylinder arrangements in driving the first and second outer cylindrical members will cause the driving member to rotate in one direction only.

In a first operational mode of the inventive apparatus, the hydraulic piston and cylinder arrangements driving the first outer cylindrical member and the hydraulic piston and cylinder arrangements driving the second outer cylindrical member are operated in series or alternating fashion. A workpiece engaged by the opening in the driving member will thereby have force applied to it in a relatively continuous fashion, because, as one of the outer cylindrical members is being cycled back to its starting position, the other is being driven to apply rotational action to the driving member. The constant cycling of the first and second outer cylindrical members in this fashion will have the net effect of applying substantially continuous rotational action to the driving member.

This reciprocating action (in series) reduces by virtually 50% the time and labor needed, in comparison with conventional hydraulic wrenches, which depend solely on the power stroke or force of pistons only. When the pistons are retracted, no force is applied. Since this occurs through 50% of the cycle, 50% of the time is lost while the pistons are being rearmed. The present invention maintains a continuous power force when series action is in operation, which saves time in applying torque to a workpiece.

Alternatively, in a second operational mode of the inventive apparatus, the hydraulic piston and cylinder arrangements driving the first and second outer cylindrical members are operated in parallel, that is, both of the first and second outer cylindrical members are driven and then returned to their starting position together. In this mode, force is applied to the workpiece in an intermittent fashion, yet with virtually twice the force applied than where it is applied only by the action of one outer cylindrical member at a time.

In order to permit each push-pull hydraulic piston and cylinder arrangement to constitute greater area to apply force at least equivalent to that applied in hydraulic arrangements used in conventional hydraulic torque wrenches, yet still be able to accommodate four pairs of hydraulic piston and cylinder arrangements within the inventive hydraulic torque actuator, each hydraulic piston and cylinder should be oval in shape. In this way, the frontal area and power of each push-pull piston is comparable to a circular piston of a larger diameter. The width of the piston and cylinder is substantially less than a circular piston and cylinder of equivalent power. Thus, when two oval push-pull piston and cylinders are "stacked" side by side, the width is substantially less than if circular pistons and cylinders were used.

The push-pull arrangement of the hydraulic cylinders with oval pistons, equidistant from the actuator center line, provides for the application of equal force or torque to the workpiece. This eliminates friction and side loading effects which produce untrue output torque.

In order to operate the inventive hydraulic torque apparatus in either of its operational modes, and to operate so as to drive each of the first and second outer cylindrical members in either the clockwise or counterclockwise direction (i.e., to apply torque or untorque driving force to the workpiece), without requiring a complex series of hydraulic valving arrangements, a coaxial multi-operational fluid valve is provided. Such a valve includes an inner disk having a series of ports connected by fluid passageways and an outer concentric disk also having a series of ports connected by fluid passageways. The ports and fluid passageways of the inner disk and those of the outer disk cooperate with a manifold abutting both the inner disk and the outer disk to control the flow of hydraulic fluid to the hydraulic torque actuator. In this way, control of the valve can either maintain the hydraulic torque actuator of the present invention in an off position or an on position. More importantly, control of the valve can set the hydraulic torque actuator into either of its operational modes (series or parallel) and can control to application of rotational force in either the clockwise or counterclockwise direction.

This is accomplished by rotating the inner and outer disks of the valve relative to each other and to the manifold by handles which extend from each disk. Rotation of the disks creates hydraulic fluid flow between the disks and the manifold and into the hydraulic piston and cylinder arrangements of the actuator. By changing the position of the inner and outer disks relative to the manifold, the flow can be controlled to operate the hydraulic piston and cylinder arrangements in either series or parallel fashion (i.e., the two operational modes of the actuator), and to power the hydraulic oval piston and cylinder arrangements to drive the first and second outer cylindrical members in either the clockwise or counterclockwise direction.

Other objects, aspects, and features of the present invention, in addition to those mentioned above, will be pointed out in, or will be understood from the following detailed description, provided in conjunction with the accompanying drawings.

Figure 7:
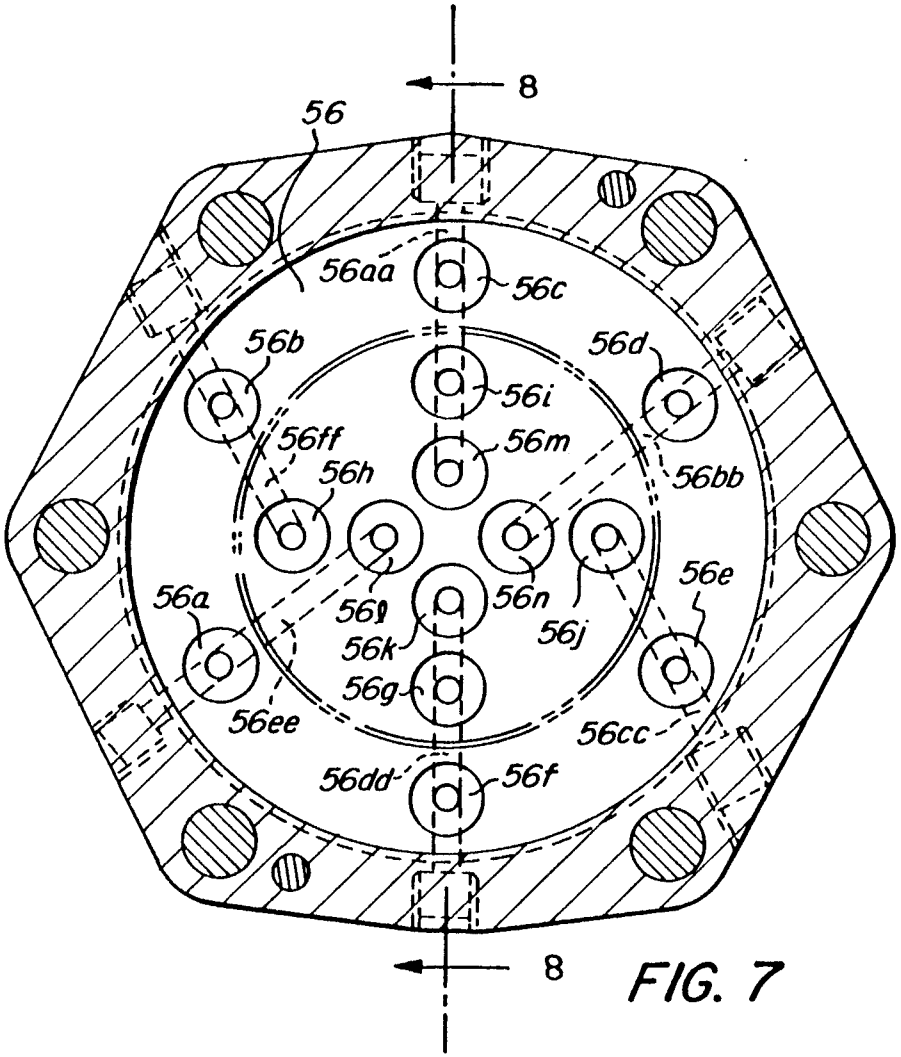
FIG. 7 is a front plan view along lines 7—7 of FIG. 8 of a manifold for controlling the flow of hydraulic fluid to the apparatus for the application of rotational force to a workpiece in accordance with FIG. 1, showing several of the fluid passageways in phantom.
Figure 10:
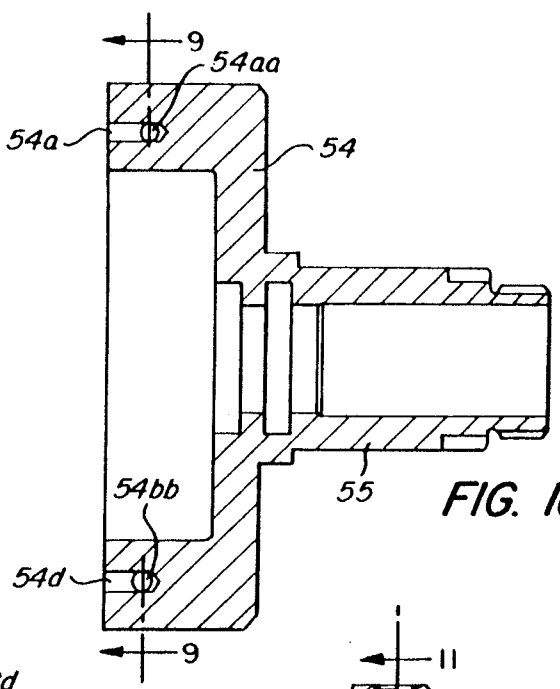
FIG. 10 is cross-sectional view of the outer disk of the valve taken along lines 10—10 of FIG. 9.
Figure 12:
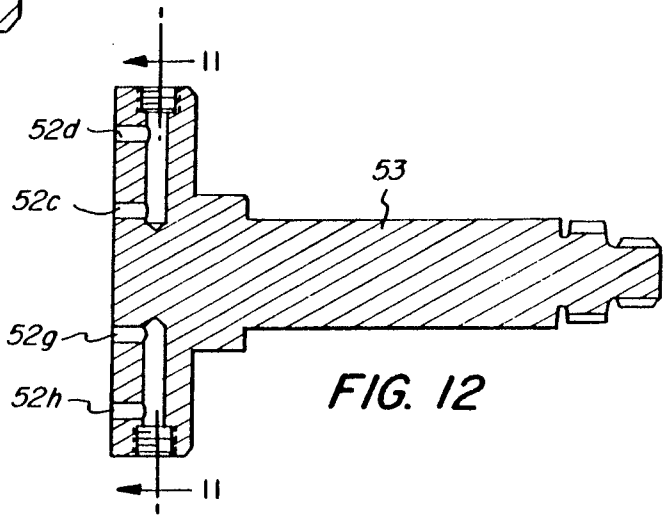
FIG. 12 is a cross-sectional view of the inner disk of the valve taken along lines 12—12 of FIG. 11.

FIGS, 14, 15, 16, 17, and 18 are schematic representations of the valve of FIG. 7, showing the hydraulic fluid passageways when the valve of FIG. 7 is in a variety of orientations.

Figure 9:
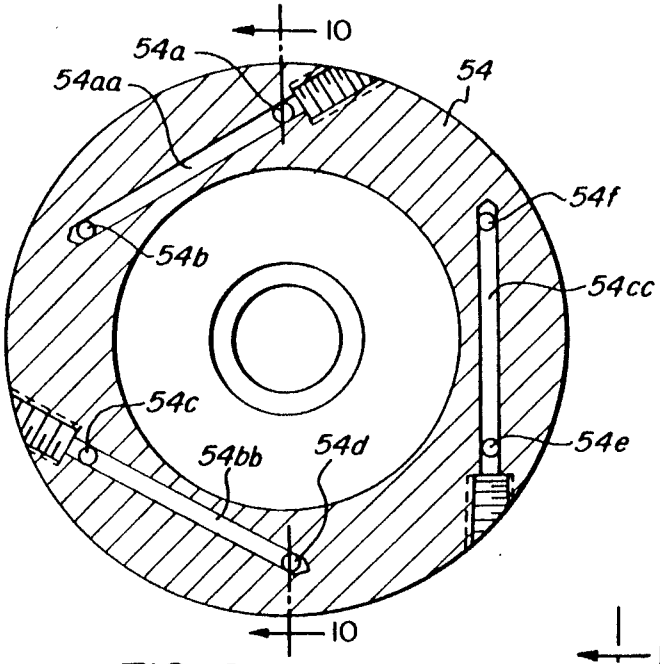
FIG. 9 is a cross-sectional view of the outer disk of the valve of FIG. 7, taken along lines 9—9 of FIG. 10.
Figure 14B:
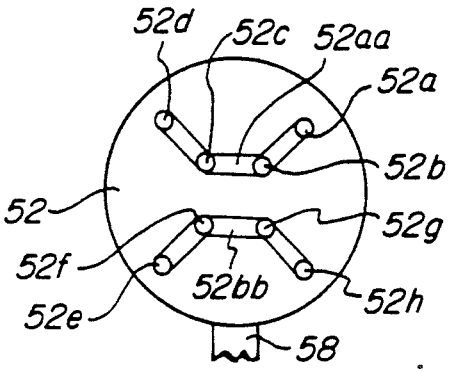
Figure 14A:
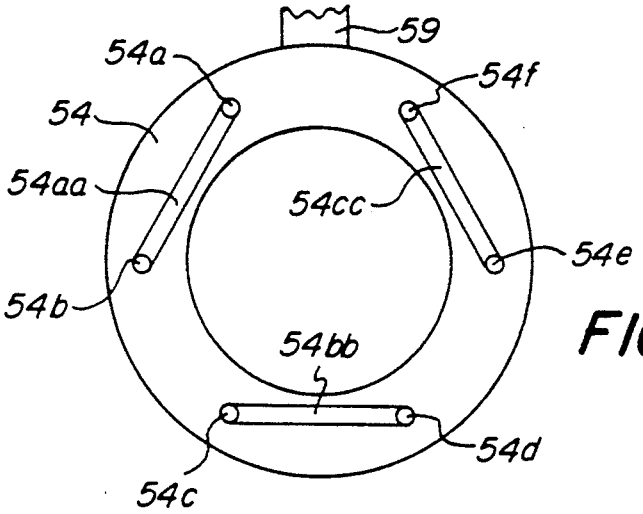

FIGS. 14*aa*, 15*aa*, 16*aa*, 17*aa*, and 18*aa* are schematic representations of the outer disk of FIG. 9, showing its orientation when the valve of FIG. 7 is in a variety of orientations.

Figure 11:
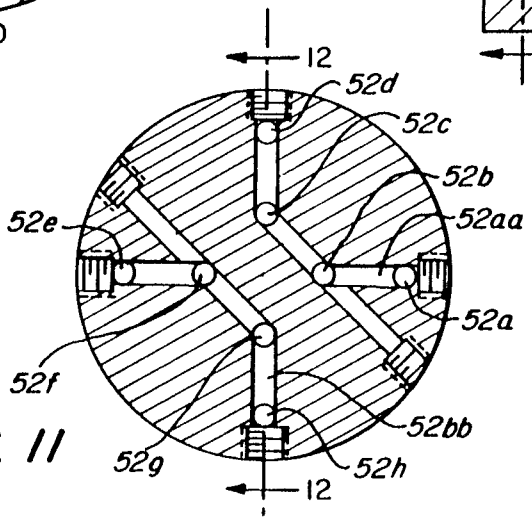
FIG. 11 is a cross-sectional view of the inner disk of the valve taken along lines 11—11 of FIG. 12.

FIGS. 14*bb*, 15*bb*, 16*bb*, 17*bb*, and 18*bb* are schematic representations of the inner disk of FIG. 11, showing its orientation when the valve of FIG. 7 is in a variety of orientations.

SCHEMATIC REPRESENTATIONS OF THE DRAWINGS

Figure 14:
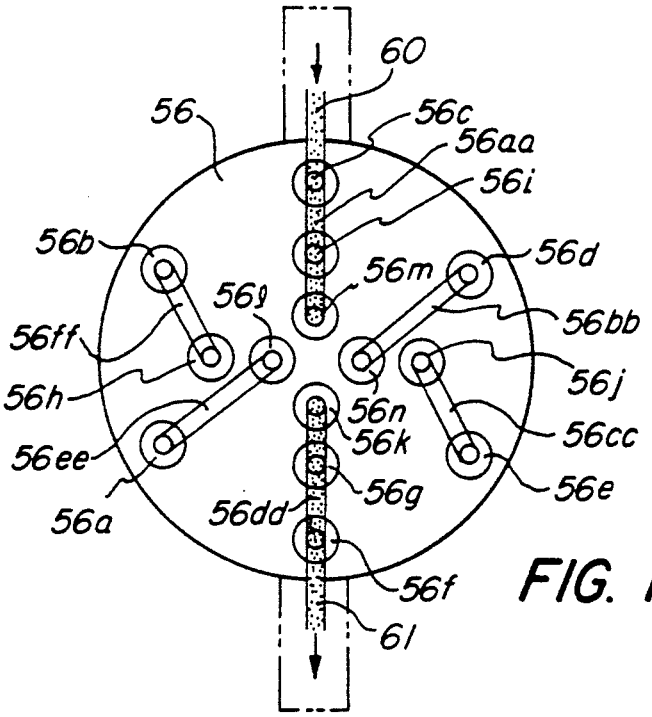

FIGS. 14, 14*aa*, and 14*bb* are schematic representations of the valve of FIG. 7 showing the respective hydraulic fluid passageways when the valve of FIG. 7 is in a closed orientation.

FIGS. 15, 15*aa*, and 15*bb* are schematic representations of the valve of FIG. 7 showing the respective hydraulic fluid passageways when the valve of FIG. 7 is in an orientation such that both outer cylindrical members are rotated in a clockwise direction at the same time.

FIGS. 16, 16*aa*, and 16*bb* are schematic representations of the valve of FIG. 7 showing the respective hydraulic fluid passageways when the valve of FIG. 7 is in an orientation such that both outer cylindrical members are rotated in a counterclockwise direction at the same time.

FIGS. 17, 17*aa*, and 17*bb* are schematic representations of the valve of FIG. 7 showing the respective hydraulic fluid passageways when the valve of FIG. 7 is in an orientation such that the first outer cylindrical member is rotated in a clockwise direction when the second outer cylindrical member is rotated in a counterclockwise direction.

FIGS. 18, 18*aa*, and 18*bb* are schematic representations of the valve of FIG. 7 showing the respective hydraulic fluid passageways when the valve of FIG. 7 is in an orientation such that the first outer cylindrical member is rotated in a counterclockwise direction when the second outer cylindrical member is rotated in a clockwise direction.

For the sake of convenience, it is suggested that drawing FIGS. 14–18*bb* be separated from this document and viewed side-by-side while reviewing the description, to engender a better understanding of the invention.

DETAILED DESCRIPTION OF THE PREFERRED EMBODIMENT

Referring now to FIGS. 1–18*bb*, where like elements are identified by like numbers in the drawings, an apparatus is shown generally at 10, which is suited for accurately applying rotational force to a workpiece. For ease of description, not all reference characters are shown in each drawing figure.

Figure 6:
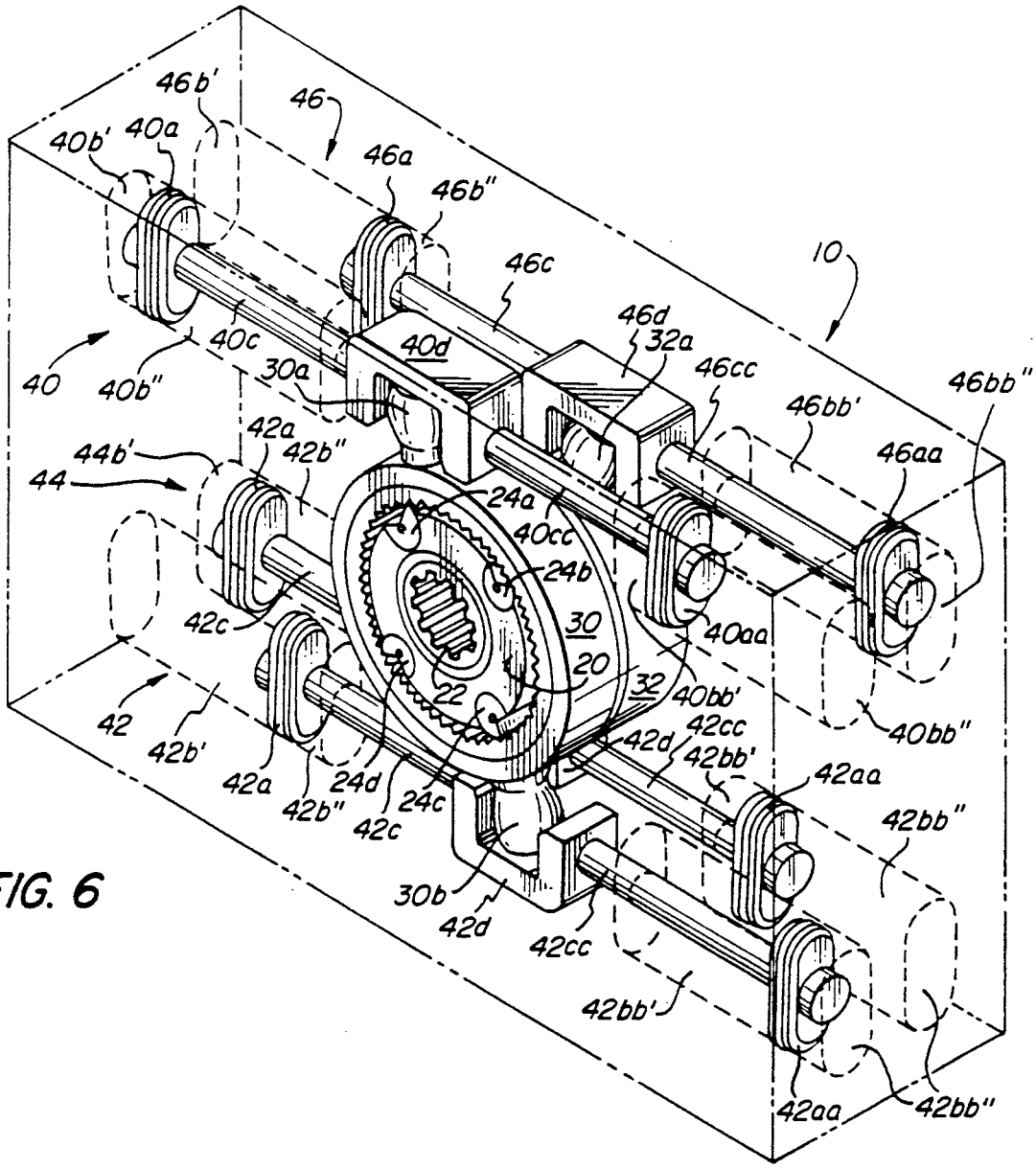
FIG. 6 is a perspective view of the inner workings of the apparatus for the application of rotational force to a workpiece in accordance with FIG. 1.

Referring to FIG. 6, apparatus 10 generally comprises a cylindrical driving member 20 which is rotatable and comprises an opening 22 sized to receive a workpiece (not shown). Opening 22 can be rectangular (especially square) in shape or it can assume other geometric shapes, such as a hexagon, but most preferably, opening 22 is splined, in order to more easily receive a workpiece to be engaged therewith. The size and shape of opening 22 can be varied depending on the workpiece to be engaged thereby. For instance, if the workpiece is a socket or the head of a bolt or other threaded connector, the size of opening 22 can be sufficient to engage the head of the workpiece therein.

In addition, apparatus 10 comprises a first outer cylindrical member 30 and a second outer cylindrical member 32. Each of first and second outer cylindrical members 30 and 32 are concentrically disposed about driving member 20 and they are in a ratcheting relationship thereto. By this is meant that, as either of first outer cylindrical member 30 or second outer cylindrical member 32 is rotated in a given direction, driving member 20 is rotated therewith, but rotation of either first outer cylindrical member 30 or second outer cylindrical member 32 in the opposite direction will not cause rotation of driving member 20.

A ratcheting relationship between first and second outer cylindrical members 30 and 32 and driving member 20 can be accomplished by disposing projections, such as teeth 34, on the inner circumferential surface of both first outer cylindrical member 30 and second outer cylindrical member 32, and at least one tooth engaging member 24 at the outer surface of driving member 20. In this way, tooth engaging member 24 is engaged by teeth 34 when first outer cylindrical member 30 and second outer cylindrical member 32 are rotated in a first direction, but tooth engaging member 24 is not engaged by teeth 34 when first outer cylindrical member 30 and second outer cylindrical member 32 are rotated in a second direction.

As illustrated in FIG. 6, a preferred form of tooth engaging member 24 comprises an elongate rod having a round cross-section and a radial segment removed therefrom, so as to provide an angular edge which can be engaged by teeth 34. Preferably, there are eight tooth engaging members, 24*a*, 24*a'*, 24*b*, 24*b'*, 24*c*, 24*c'*, 24*d* and 24*d'*, arrayed about driving member 20. Each of tooth engaging members 24*a*, 24*b*, 24*c*, and 24*d* are arrayed between driving member 20 and first outer cylindrical member 30; and each of tooth engaging members 24*a'*, 24*b'*, 24*c'*, and 24*d'*, are arrayed between driving member 20 and second outer cylindrical member 32. In order to reverse the direction in which first outer cylindrical member 30 and second outer cylindrical member 32 drive driving member 20, each of tooth engaging members 24*a*–24*d* is rotated on a central shaft, 26*a*, 26*a'*, 26*b*, 26*b'*, 26*c*, 26*c'*, 26*d*, and 26*d'* so that a second angular edge is exposed to teeth 34.

In order to permit rotation of tooth engaging members 24*a*–24*d'* from one side of apparatus 10 (since the other is likely to be mounted against a surface) communication pins 27*a*, 27*b*, 27*c*, and 27*d* are provided, to engage tooth engaging members 24*a'*, 24*b'*, 24*c'*, and 24*d'*.

Figure 4:
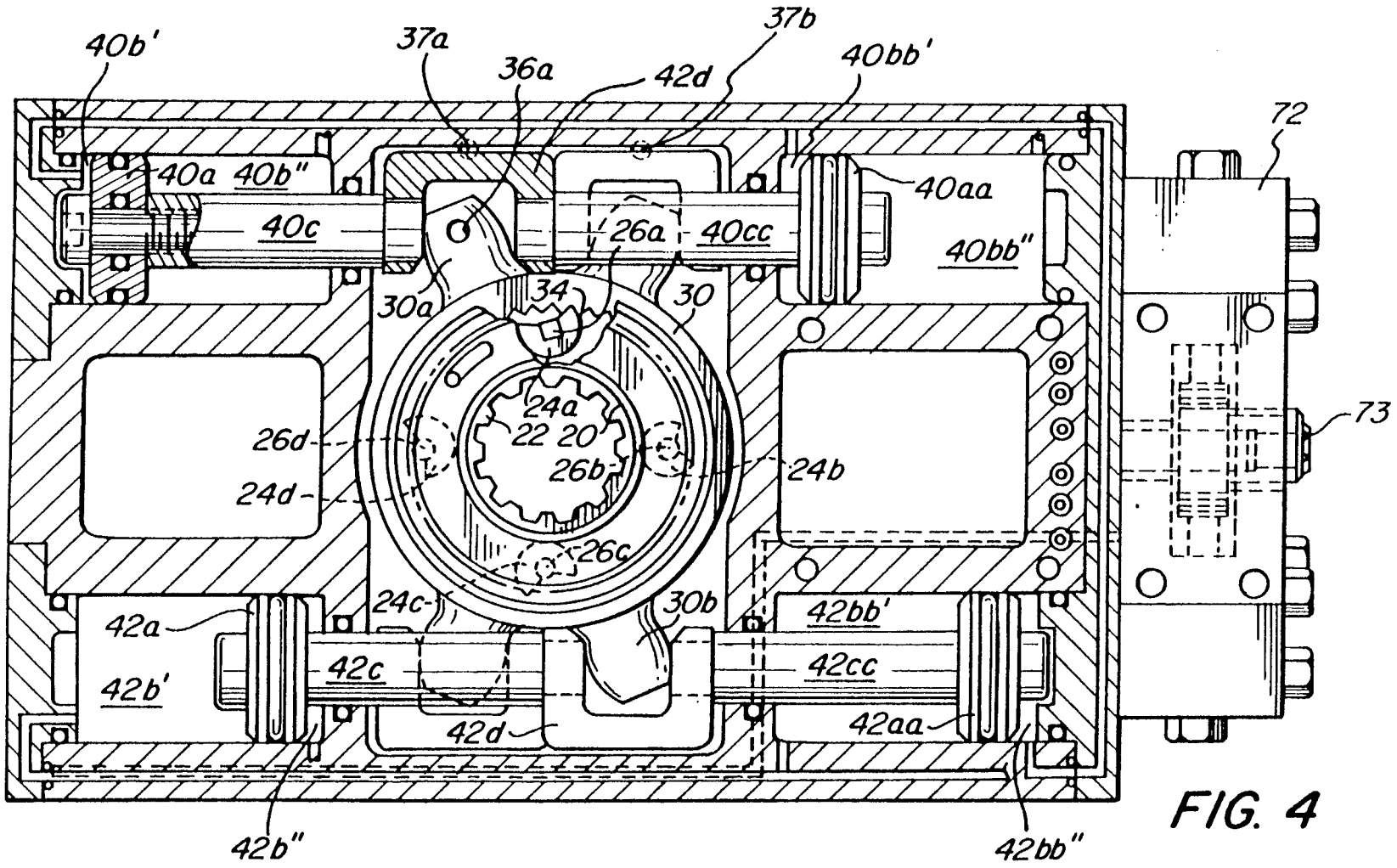
FIG. 4 is a partially broken away cross-sectional view of the apparatus taken along lines 4—4 of FIG. 2.
Figure 5:
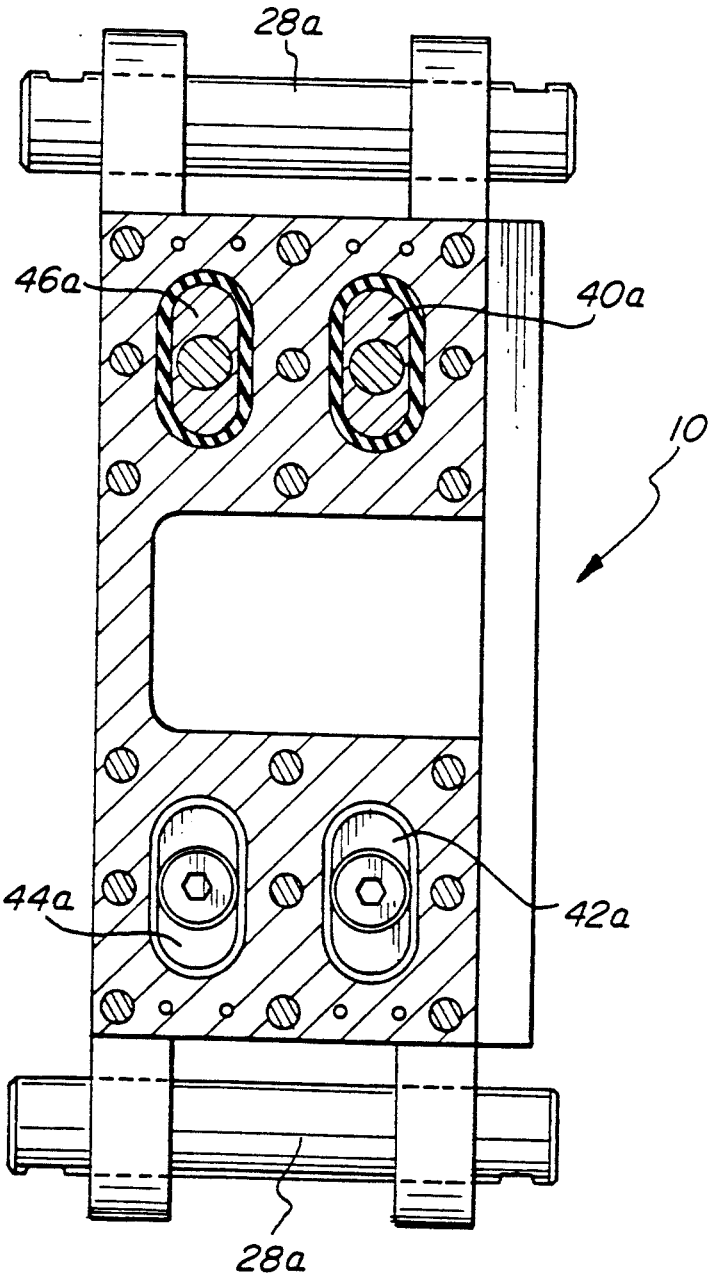
FIG. 5 is a cross-sectional view of the apparatus of FIG. 4 taken along lines 5—5.

For instance, when tooth engaging members 24*a*–24*d* are in the orientation illustrated in FIG. 4 and FIG. 6, rotation of first and second outer cylindrical members 30 and 32 in a clockwise direction will impart clockwise rotation to driving member 20, whereas counterclockwise rotation of first and second outer cylindrical members 30 and 32 will not impart any rotation to driving member 20. Contrariwise, if tooth engaging members 24*a*–24*d* are rotated on shafts 26*a*–26*d*, rotation of first and second outer cylindrical members 30 and 32 in a counterclockwise direction will impart counterclockwise rotation to driving member 20, whereas clockwise rotation of first and second outer cylindrical members 30 and 32 will not impart any rotation to driving member 20.

In order to apply rotational force to driving member 20, each of first outer cylindrical member 30 and second outer cylindrical member 32 is reciprocatingly driven by at least one and preferably two pairs of hydraulic cylinder and piston arrangements. More specifically, first outer cylindrical member 30 is driven by first hydraulic piston and cylinder arrangement 40 and second hydraulic piston and cylinder arrangement 42, and second outer cylindrical member 32 is driven by third hydraulic piston and cylinder arrangement 44 and fourth hydraulic piston and cylinder arrangement 46. Hydraulic piston and cylinder arrangement 40 comprises two oval pistons 40*a* and 40*aa*, each of which is disposed within a cylinder, 40*b* and 40*bb*. Oval pistons 40*a* and 40*aa* are connected to each other via rods 40*c* and 40*cc*. Rods 40*c* and 40*cc* are connected through engagement piece 40*d*.

Referring to both FIG. 4 and FIG. 6 simultaneously, cylinder 40b is divided into two sections, 40b', and 40b'' by oval piston 40a. Likewise, cylinder 40bb is divided into 40bb', and 40bb'' by oval piston 40aa. When hydraulic fluid is forced into cylindrical sections 40b' and 40bb', pistons 40a and 40aa are driven from left to right in the orientation illustrated in FIG. 4. Similarly, when hydraulic fluid is forced into cylindrical section 40b'' and 40bb'', oval pistons 40a and 40aa are forced from right to left in that same orientation. Accordingly, when left to right motion of engagement piece 40d is desired, hydraulic fluid is forced into both cylindrical sections 40b', and 40bb'. Contrariwise, when right to left action is desired, hydraulic fluid is forced into cylindrical sections 40b'' and 40bb'' which forces oval pistons 40a and 40aa from right to left. Of course, when hydraulic fluid is forced into any of cylindrical sections 40b', 40bb', 40b'' and 40bb'', hydraulic fluids is forced out of the corresponding cylindrical section.

Each of the other hydraulic piston and cylinder arrangements 42, 44, and 46 has elements corresponding to those of hydraulic piston and cylinder arrangement 40, which are numbered similarly.

Figure 1:
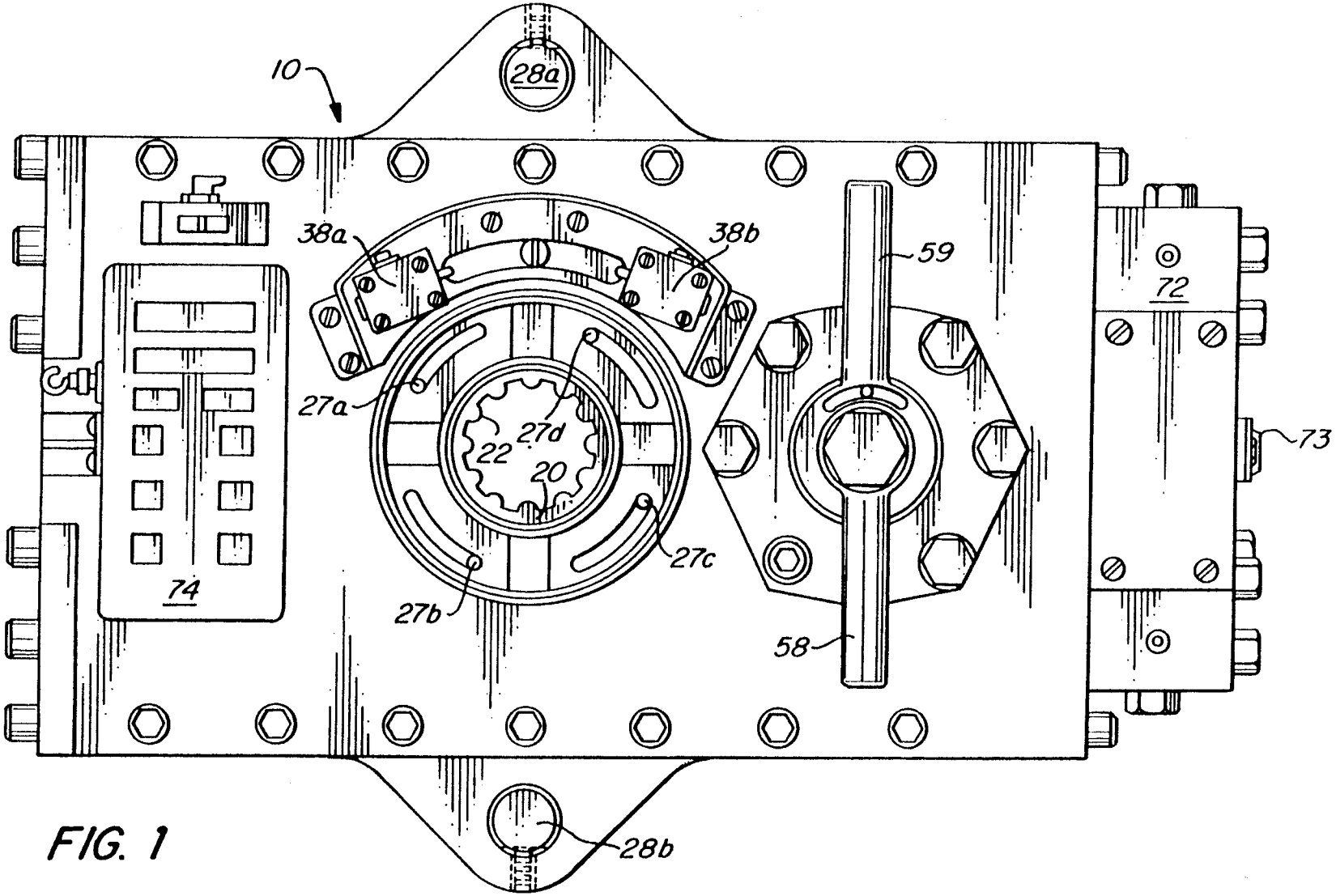
FIG. 1 is a front plan view of an embodiment of an apparatus for applying rotational force to a workpiece accordance with the invention.
Figure 2:
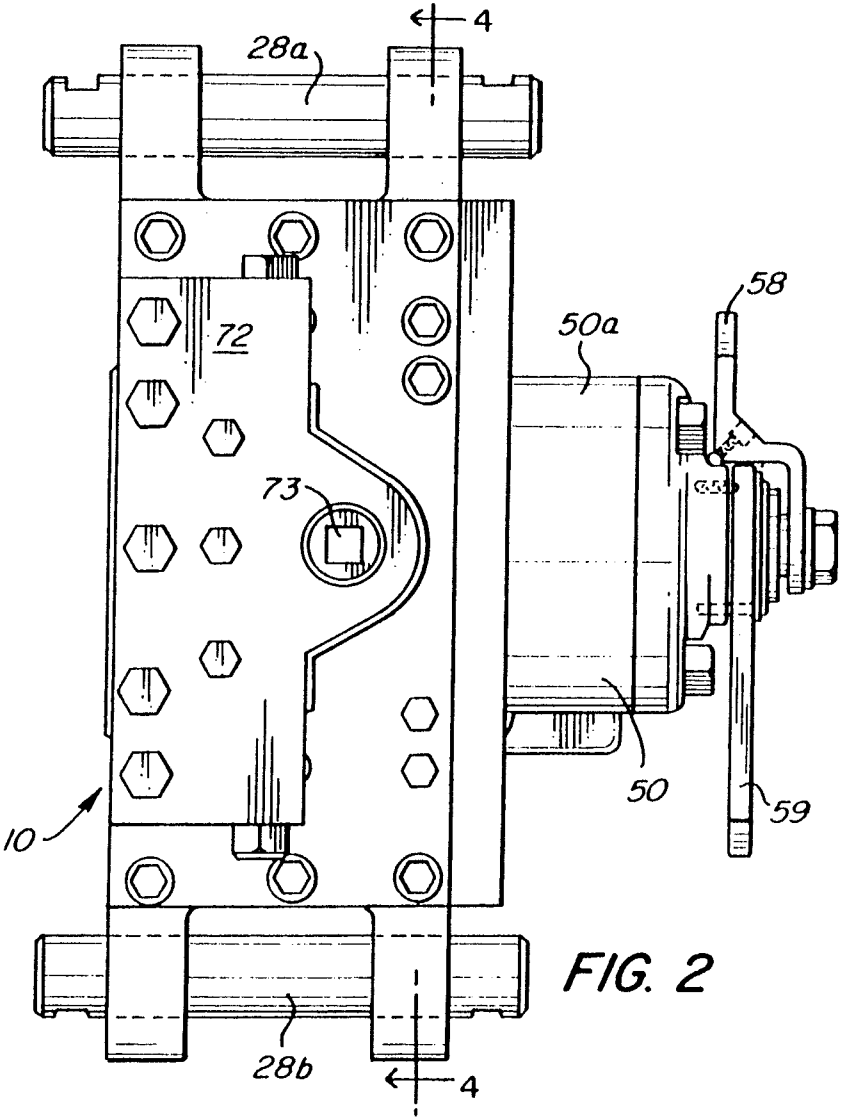
FIG. 2 is a side plan view of the apparatus for applying rotational force to a workpiece in accordance with FIG. 1.
Figure 3:
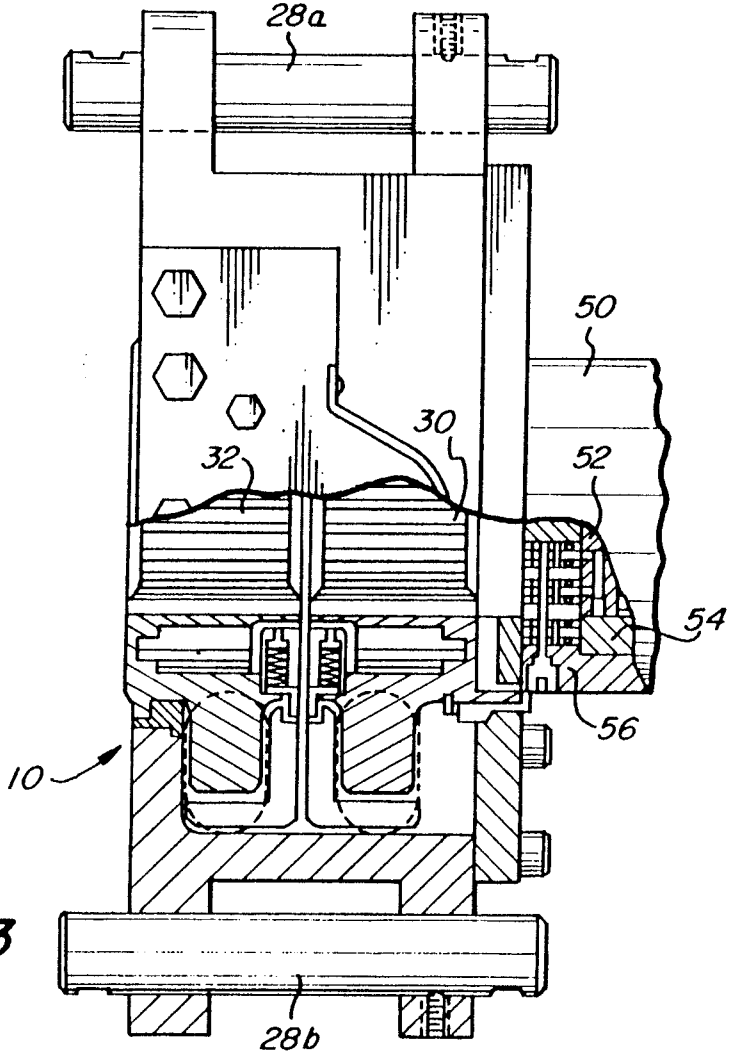
FIG. 3 is a partially broken away side plan view of an apparatus for the application of rotational force to a workpiece in accordance with FIG. 2.

Referring now to FIGS. 1, 2, and 3, apparatus 10 further comprises two torque reaction shear pins, 28a and 28b, respectively, which are mounted so as to be diametrically opposed in the housing 12 of apparatus 10. Torque reaction shear pins 28a and 28b accept the counter torque forces when fluid under pressure is applied to hydraulic piston and cylinder arrangments 40, 42, 44, and 46.

Referring now to FIG. 6, each of first outer cylindrical member 30 and second outer cylindrical member 32 have depending therefrom at least one, and preferably two, studs, 30a, 30b, 32a, 32b, disposed about first and second outer cylindrical members 30 and 32 180° apart and equidistant from the center line of apparatus 10. Each of studs 30a, 30b, 32a, and 32b, is engaged respectively by one of engagement pieces 40d, 42d, 44d, and 46d. In this way, the reciprocating action of each of hydraulic piston and cylinder arrangements 40, 42, 44, and 46 forces rotational action on first outer cylindrical member 30 and second outer cylindrical member 32 by the action of engagement pieces 40d, 42d, 44d, and 46d on studs 30a, 30b, 32a, and 32b. This translates the linear motion of engagement pieces 40d, 42d, 44d, and 46d to angular motion of first and second outer cylindrical members 30 and 32.

Because hydraulic oval piston and cylinder arrangements 40, 42, 44, and 46 operate in a reciprocatingly linear fashion, the rotational force applied to first outer cylindrical member 30 and second outer cylindrical member 32 has a starting point shown in solid lines in FIG. 4 and then proceeds through an arc of no more than about 44° to its finishing point shown in phantom in FIG. 4, from which it then returns to its starting point. For instance, as illustrated in FIG. 4, the application of hydraulic fluid to cylindrical segments 40b', 40bb', 42b'' and 42bb'' will force pistons 40a and 40aa from left to right and pistons 42a and 42aa from right to left. This will move engagement piece 40d from left to right and engagement piece 42d from right to left, which applies a clockwise rotational force to first outer cylindrical member 30 via studs 30a and 30b. Return of pistons 40a, 40aa, 42a, and 42aa to their starting positions will then rotate first outer cylindrical member 30 in counterclockwise direction back to its original position of rotation.

In order to prevent hydraulic piston and cylinder arrangements 40, 42, 44, and 46 from "bottoming out" at the end of each reciprocating stroke, which can lead to false torque readings and severe stress on apparatus 10, studs 30a and 32a are each fitted with a travel limit pin, 36a and 36b, respectively. Travel limit pins 36a and 36b contact hydraulic limit switches 37a and 37b which thereby actuate a pair of solenoids, 38a and 38b, which automatically cause cycling of hydraulic piston and cylinder arrangements 40, 42, 44, and 46 to thereby avoid bottoming out of pistons 40a, 40aa, 42a, 42aa, 44a, 44aa, 46a, and 46aa. In a most preferred embodiment, travel limit pins 36a and 36b and hydraulic limit switches 37a and 37b are set such that each piston stroke ends just prior to the point of bottoming out, for instance, approximately ⅛ of an inch prior to bottoming out. In this way, false torque readings and stress on housing 12 of apparatus 10 is prevented.

In the embodiment shown in FIG. 4, clockwise rotation of first outer cylindrical member 30 causes clockwise rotation of driving member 20 because tooth engaging members 24a–24d are engaged by teeth 34 when first outer cylindrical member 30 is rotated in the clockwise direction. When being rotated in the counterclockwise direction back to its original position, teeth 34 "slide" by tooth engaging members 24a–24d in a ratcheting fashion such that counterclockwise rotation of first outer cylindrical member 30 will not cause rotation of driving member 20. Of course it will be recognized that rotational repositioning of tooth engaging members 24a–24d about shafts 26a–26d will cause counterclockwise rotation of driving member 20 when first outer cylindrical member 30 is rotated in a counterclockwise direction, and no rotation of driving member 20 when first outer cylindrical member 30 is rotated in a clockwise direction.

In a first operational mode of apparatus 10, first outer cylindrical member 30 and second outer cylindrical member 32 are rotated by hydraulic piston and cylinder arrangements 40, 42, 44, and 46 in series. That is, when first outer cylindrical member 30 is rotated in the clockwise direction by hydraulic piston and cylinder arrangements 40 and 42, second outer cylindrical member 32 is rotated in the counterclockwise direction by hydraulic piston and cylinder arrangements 44 and 46, and vice versa. In this way, when first outer cylindrical member 30 is drivingly rotating driving member 20 in the clockwise direction, second outer cylindrical member 32 is returning to its starting position by counterclockwise rotation, which does not effect the rotation of driving member 20 because of the ratcheting relationship between second outer cylindrical member 32 and driving member 20. Likewise, when second outer cylindrical member 32 is drivingly rotating driving member 20 in the clockwise direction, first outer cylindrical member 30 is returning to its original position by counterclockwise rotation, which also does not effect the clockwise rotation of driving member 20. This same principle also applies if driving member 20 is being driven in the counterclockwise direction by first outer cylindrical member 30 and second outer cylindrical member 32.

Because of this alternating or series application of rotational force to driving member 20 by first outer cylindrical member 30 and second outer cylindrical member 32, a relatively continuous rotational force is applied to driving member 20. This is in contradistinction to conventional hydraulic torque actuators, which provide only one means for applying rotational force to a central driving member. Therefore, the rotational force in these old devices is intermittent in nature since the application of force ceases while the apparatus applying the force is cycled back to its starting position.

In a second operational mode of apparatus 10, both first outer cylindrical member 30 and second outer cylindrical 32 are operated in parallel, that is, they are both being rotated in the same direction at the same time. This is accomplished by coordinating hydraulic piston and cylinder arrangements 40, 42, 44, and 46 such that engagement pieces 40*d*, 42*d*, 44*d*, and 46*d* are rotating first outer cylindrical member 30 and second outer cylindrical member 32 clockwise at the same time, and returning them to their original position (i.e., rotating them in a counterclockwise direction) at the same time. In this way, virtually twice the force is applied to driving member 20 as when only one of first outer cylindrical member 30 and second outer cylindrical member 32 is applying rotational force at one time. High powered rotation can therefore be applied to the workpiece, especially when tightening is desired.

In a unique and advantageous aspect of this invention, coordination of the actions of hydraulic piston and cylinder arrangements 40, 42, 44, and 46 so as to utilize apparatus 10 in either of its operational modes, can be accomplished via a coaxial valve 50 which coordinates the distribution of hydraulic fluid to hydraulic piston and cylinder arrangements 40, 42, 44, and 46. Valve 50 generally comprises an inner disk 52, an outer disk 54, and a manifold 56. By the rotation of inner disk 52 and outer disk 54 with respect to manifold 56, flow of hydraulic fluid to hydraulic piston and cylinder arrangements 40, 42, 44, and 46 can be controlled to effect either of the operational modes of apparatus 10.

More specifically, and referring now to FIG. 11, inner disk 52 comprises a series of ports 52*a*–52*h*. In addition, inner disk 52 comprises a series of fluid passageways 52*aa* and 52*bb* for shunting hydraulic fluid between and among ports 52*a*–52*h*. Referring now to FIG. 9, outer disk 54, which is disposed concentrically about inner disk 52, comprises ports 54*a*–54*f* and shunt passageway 54*aa* which connects ports 54*a* and 54*b*, shunt passageway 54*bb* which connects ports 54*c* and 54*d*, and shunt passageway 54*cc* which connects ports 54*e* and 54*f*. In addition, referring to FIG. 7, valve 50 comprises manifold 56 comprising ports 56*a*–56*n* and shunt passageways 56*aa*, 56*bb*, 56*cc*, 56*dd*, 56*ee*, and 56*ff* for fluid flow from a reservoir (not shown) to valve 50, from valve 50 back to the reservoir, and then from valve 50 to apparatus 10 and from apparatus 10 back to valve 50. Manifold 56 is also in the form of a disk which abuts inner disk 52 and outer disk 54.

Figure 8:
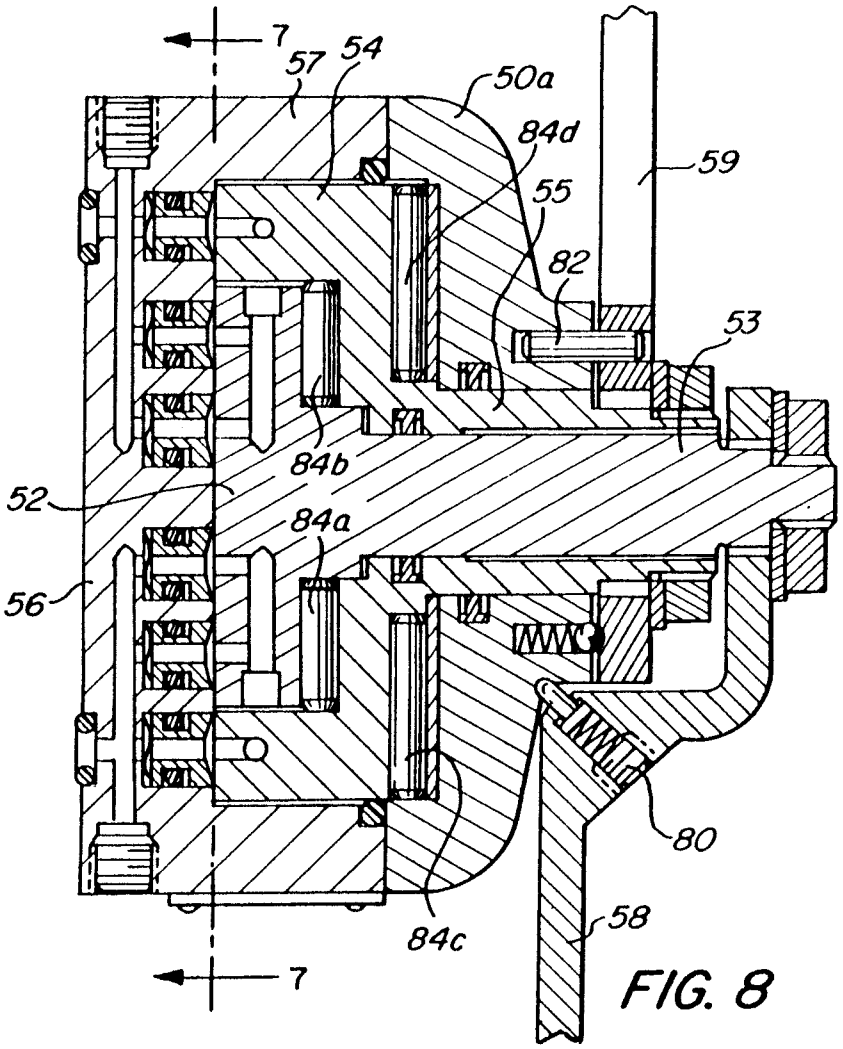
FIG. 8 is a cross-sectional view of the valve of FIG. 7 taken along lines 8—8.

Referring now to FIG. 8, in order to facilitate handling and assembly of valve 50, inner disk 52 has a cylindrical stem 53 extending therefrom. In addition, outer disk 54 has a cylindrical stem 55 extending therefrom and which is concentrically disposed about stem 53 of inner disk 52. In addition, manifold 56 has a flange 57 extending therefrom which fits about outer disk 54. In this way, a fitting 50*a* can be applied about inner disk 52 and outer disk 54 and against manifold 56, which therefore assembles and maintains valve 50 in its assembled position on apparatus 10.

In addition, valve 50 comprises elements which maintain its integrity and operability, including suitable "O" ring seals and shear seals as would be understood by the skilled artisan. In addition, a plunger stop 80 is provided to position the ports of inner disk 52 to coincide with fluid passages so that fluid under pressure is not restricted during flow through inner disk 52. In addition, a pin stop 82 is provided to position outer disk 54 such that it coincides with the fluid passages such that fluid flow under pressure is not restricted as it flows through outer disk 54. Furthermore, thrust roller bearing pins 84*a*, 84*b*, 84*c*, and 84*d* are provided to facilitate the rotation of inner disk 52, and outer disk 54 with respect to manifold 56.

In addition, and referring now to FIGS. 1 and 2, inner disk 52 has extending therefrom a handle 58 which is used to rotate inner disk 52. Inner disk 52 can rotate from a closed position illustrated in FIGS. 14*bb*, 17*bb*, and 18*bb* to 45° in either direction illustrated in FIBS. 15*bb* and 16*bb*. In addition, outer disk 54 also comprises a handle 59 which is used to rotate outer disk 54. Outer disk 54 can rotate from a closed position illustrated in FIGS. 14*aa*, 15*aa*, and 16*aa* to 30° in either direction illustrated in FIGS. 17*aa* and 18*aa*. In this way, both inner disk 52 and outer disk 54 can be rotated with respect to manifold 56. In place of handles 58 and 59, a series of rack and pinion gears can be attached to valve 50 (for instance, via twin solenoids and electro-limit switches) in order to rotate inner disk 52 and outer disk 54 with respect to manifold 56.

Figure 13:
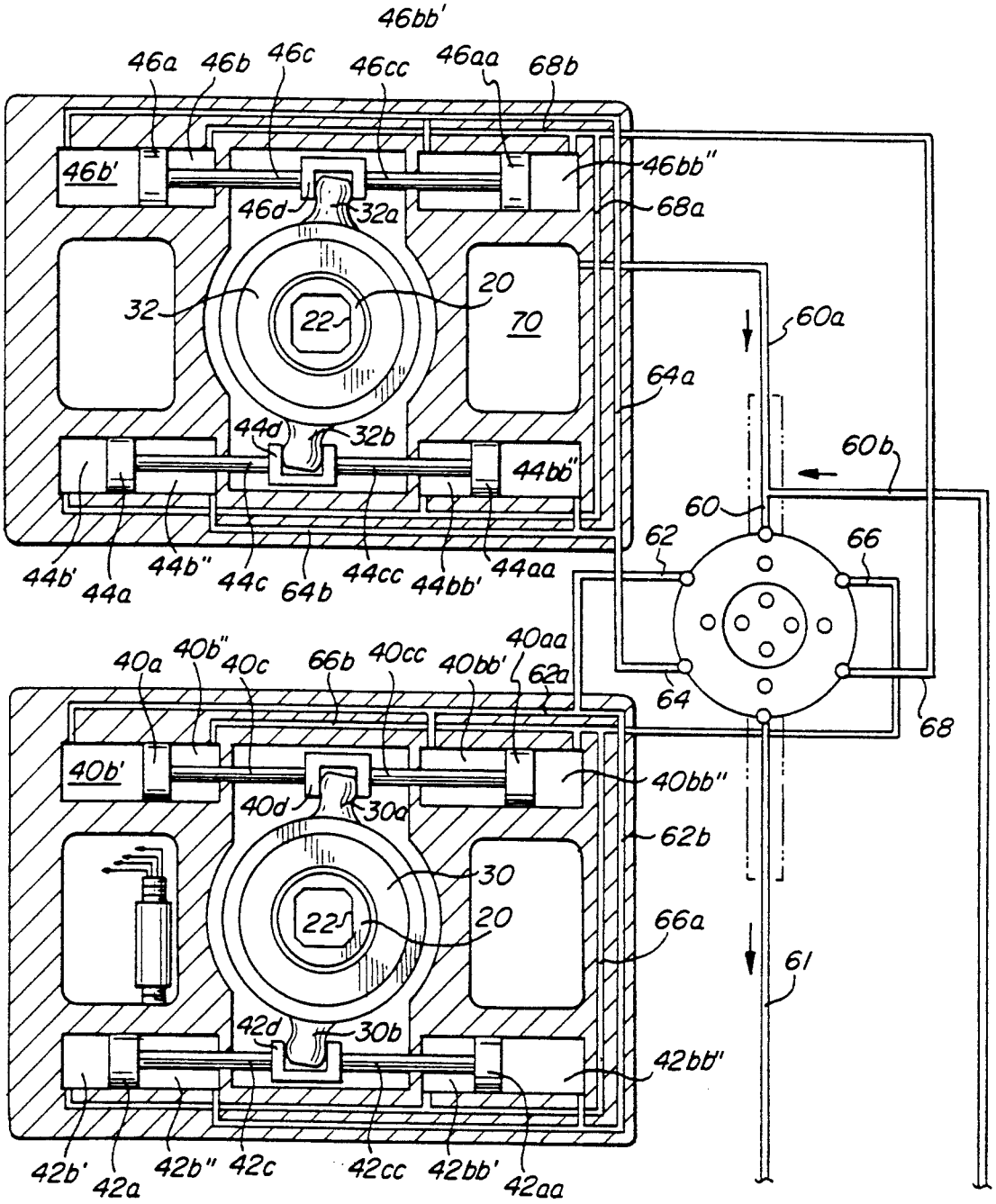
FIG. 13 is a schematic representation of the hydraulic fluid flow lines between the valve of FIG. 7 and the apparatus of FIG. 1.

FIG. 13 provides a schematic illustration of the arrangement of hydraulic fluid flow lines 60, 62, 64, 66, and 68 which control the flow of hydraulic fluid into valve 50, from valve 50 into apparatus 10, and then from apparatus 10 back to valve 50 and from there to disposal. FIG. 13 illustrates apparatus 10 divided into two halves, the first having first outer cylindrical member 30 and related hydraulic piston and cylinder arrangements 40 and 42, and the second half having second outer cylindrical member 32 and related hydraulic piston and cylinder arrangements 44 and 46.

More specifically, and referring also to FIG. 1, hydraulic fluid flows from reservoir 70, and/or from an outside source, such as dual action hydraulic hand pump 72 which can be operated by a handle inserted into drive 73, or external hydraulic power supply (not shown) through hydraulic fluid supply lines 60*a* and 60*b* which meet as hydraulic fluid supply line 60, and is fed into valve 50. Hydraulic fluid supply lines 62, 64, 66, and 68 then supply hydraulic fluid to hydraulic piston and cylinder arrangements 40, 42, 44, and 46 and receive return of hydraulic fluid from hydraulic piston and cylinder arrangements 40, 42, 44, and 46 to valve 50 from where it exits via hydraulic fluid disposal line 61.

Hydraulic fluid supply line 62 is split into supply lines 62*a* and 62*b*. Hydraulic fluid supply line 62*a* is in operative connection with cylindrical segments 40*b*′ and 40*bb*′ and hydraulic fluid supply line 62*b* is in operative connection with cylindrical segment 42*b*″ and 42*bb*″. Likewise, hydraulic fluid supply line 64 splits into lines 64*a* and 64*b*, which are in operative connection with, respectively, cylindrical segments 44*b*″, 44*bb*″ 46*b*′, and 46*bb*′. Hydraulic fluid supply line 66 splits into lines 66*a* and 66*b*, which are in operative connection with, respectively, cylindrical segments 40*b*″, 40*bb*″, 42*b*′, and 42*bb*′. Hydraulic fluid supply line 68 splits into lines 68*a* and 68*b* which are in operative connection with, respectively, cylindrical segments 44*b*′, 44*bb*′, 46*b*″ and 46*bb*″. In this way, coordination of the fluid flow through each of hydraulic fluid supply lines 62, 64, 66, and 68 can control and coordinate the operation of all hydraulic piston and cylinder arrangements 40, 42, 44, and 46.

Specifically, flow of hydraulic fluid from valve 50 through lines 62 and 64 and back to valve 50 through lines 66 and 68 will cause pistons 40*a*, 40*aa*, 46*a*, and 46*aa* to move from left to right and pistons 42*a*, 42*aa*, 44*a*, and 44*aa* to move from right to left, thereby rotating both first outer cylindrical member 30 and second outer cylindrical member 32 in a clockwise direction. The flow of hydraulic fluid out from valve 50 through lines 66 and 68 and back to valve 50 through lines 62 and 64 will cause the opposite result—counterclockwise rotation of both first outer cylindrical member 30 and second outer cylindrical member 32.

Flow of hydraulic fluid out from valve 50 through lines 62 and 68 will cause pistons 40*a*, 40*aa*, 44*a*, and 44*aa* to move from left to right and pistons 42*a*, 42*aa*, 46*a*, and 46*aa* to move from right to left. In this way, first outer cylindrical member 30 will rotate in a clockwise direction and second outer cylindrical member 32 will rotate in a counterclockwise direction. Similarly, if fluid is forced from valve 50 out through lines 64 and 66 to apparatus 10 and then back from apparatus 10 through lines 62 and 68 to valve 50, first outer cylindrical member 30 will rotate in a counterclockwise direction, and second outer cylindrical member 32 will rotate in a clockwise direction. In this way, it can be seen that control of the flow of hydraulic fluid through valve 50 will control the operational modes of apparatus 10.

Illustrations 14 through 18*bb* more clearly illustrate the options available for controlling the flow of hydraulic fluid through valve 50. Each of illustrations 14, 15, 16, 17, and 18 show the flow of hydraulic fluid through manifold 56 of valve 50 and indicate in phantom the position of handles 58 and 59. Illustrations 14*aa*, 15*aa*, 16*aa*, 17*aa*, and 18*aa* show the position of outer disk 54 to provide the fluid flow pathway illustrated respectively in illustrations 14, 15, 16, 17, and 18. Likewise, illustrations 14*bb*, 15*bb*, 16*bb*, 17*bb*, and 18*bb* show the position of inner disk 52 to provide the fluid flow pathway illustrated respectively in FIGS. 14, 15, 16, 17, and 18.

More specifically, FIGS. 14 through 14*bb* illustrate valve 50 in its "off" position, although the relative positions of the handles are shown for illustrative purposes only and can assume any orientation to provide the desired alignment of inner disk 52 and outer disk 54. It will be seen that none of the ports of either inner disk 52 or outer disk 54 are aligned with the ports of manifold 56, therefore, hydraulic fluid flowing into manifold 56 does not enter any of the fluid passageways of inner disk 52 or inner disk 54 and merely "dead ends".

When handle 58 is rotated by about 45° as illustrated in FIGS. 15, 15*aa*, and 15*bb*, the flow of hydraulic fluid in manifold passageway 56*aa* enters inner disk passageway 52*aa* through ports 52*a* and 52*b*, where it flows through ports 52*c* and 52*d* and into manifold passageways 56*ee* and 56*ff* through ports 56*h* and 56*l* and out of valve 50 through lines 62 and 64, such that both first outer cylindrical member and second outer cylindrical member are rotated in a clockwise direction as discussed above. The hydraulic fluid then reenters valve 50 via lines 66 and 68, where it flows through manifold passageways 56*bb* and 56*cc* and through ports 56*j* and 56*n* into inner disk passageway 52*bb* through ports 52*e* and 52*f* from where it flows out through inner disk ports 52*g* and 52*h* and manifold ports 56*g* and 56*k* into manifold passageway 56*dd* and out valve 50.

As illustrated in FIGS. 16, 16*aa*, and 16*bb*, the reverse action, the parallel rotation of first outer cylindrical member 30 and second outer cylindrical member 32 in the counterclockwise direction is accomplished by rotating handle 58 45° in the opposite direction. In this way, hydraulic fluid enters manifold 56 through passageway 56*aa*, which is now aligned with ports 52*a* and 52*b* such that fluid flowing through inner disk passageway 52*aa* enters manifold passageways 56*bb* and 56*cc* through manifold ports 56*n* and 56*j* where it flows out of valve 50 through lines 66 and 68 and then returns through lines 62 and 64 into manifold passageways 56*ff* and 56*ee*. The fluid then flows into inner disk passageway 52*bb* through ports 52*g* and 52*h* and then to manifold passageway 56*dd* where it flows out of valve 50.

To provide for the serial operation of apparatus 10, as illustrated in FIGS. 17, 17*aa*, and 17*bb* handle 58 remains in its "off" position. Handle 59 is rotated by 30° to one side, such that fluid entering valve 50 through manifold passageway 56*aa* flows into outer disk passageway 54*aa* through port 54*a* and then out outer disk port 54*b* into manifold passageway 56*ff* through port 56*b* where it flows to apparatus 10 through line 62. Fluid returning to valve 50 from line 64 enters at manifold passageway 56*ee* where it flows through port 56*a* to port 54*c* of outer disk 54. It then flows through outer port passageway 54*bb* and through port 54*d* to manifold port 56*f* and out manifold passageway 56*dd*. Fluid flowing back to valve 50 through line 66 enters at manifold passageway 56*bb* where it enters outer disk passageway 54*cc* through ports 56*d* and 54*f*. The fluid then flows through outer disk passageway 54*cc* and from port 54*e* to manifold passageway 56*cc* and out through line 68 to apparatus 10. In this way, first outer cylindrical member 30 is rotated in a clockwise direction and second outer cylindrical member 32 rotated in a counterclockwise direction for serial operation of apparatus 10.

Likewise, referring now to FIGS. 18, 18*aa*, and 18*bb*, when handle 59 is rotated 30° in the other direction, hydraulic fluid entering manifold 56 through passageway 56*aa* flows into outer disk passageway 54*cc* through ports 56*c* and 54*f* from where it flows through outer disk passageway 54*cc* to port 54*e* into manifold passageway 56*bb* through port 56*d* and out line 66 to apparatus 10. Fluid returning to valve 68 from apparatus 10 flows into manifold passageway 56*cc* and from port 56*e* to outer disk port 54*d*. There it flows through outer disk passageway 54*bb* and from port 54*c* through manifold port 56*f* and into manifold passageway 56*dd* and out from valve 50. Hydraulic fluid flowing back from apparatus 10 into valve 50 through line 62 enters at manifold passageway 56*ff* where it flows through ports 56*d* and 54*a* into outer disk passageway 54*aa* and there through port 54*b* into manifold passageway 56*ee* through port 56*a* and out line 64 to apparatus 10. In this way, first outer cylindrical member 30 is rotated in a counterclockwise direction and second outer cylindrical member 32 is rotated in a clockwise direction.

As can be seen, control of the relative positions of inner disk 52 and outer disk 54 of valve 50 cooperate with manifold 56 to control the flow of hydraulic fluid to apparatus 10 to permit operation in either the parallel or serial operational modes of apparatus 10. In addition, control of the driving force applied to hydraulic piston and cylinder arrangements 40, 42, 44, and 46 by valve 50 controls whether the rotational driving force is applied to independently drive first outer cylindrical member 30 and second outer cylindrical member 32 in either the clockwise or counterclockwise direction. Accordingly, appropriate control of valve 50 can control the entire operation of apparatus 10 without the complex hydraulic valving systems normally required or expected.

To facilitate control of apparatus 10, it is desired that an indication of torque and other information be provided. More specifically, an electronic digital indicator 74 can be provided which provides an indication of torque and total rotational degrees of the workpiece upon which apparatus 10 is operated.

A method for applying rotational force to a workpiece in accordance with the invention generally follows the operation of apparatus 10 discussed above, and involves applying rotational force to a first and second outer cylindrical member in either series or parallel fashion such that the rotational force is transmitted by either one or both of the outer cylindrical members at any given time to a driving member containing an opening which engages a workpiece. Operation is in series when only one of the outer cylindrical members are transmitting rotational force to the driving member at any one given time. Parallel operation is present when both outer cylindrical members is transmitting rotational force to the driving member at the same time.

The rotational force is applied to the outer cylindrical members by two pairs of hydraulic piston and cylinder arrangements for each outer cylindrical member. Each pair of hydraulic piston and cylinder arrangements is driven by a valve which selectively distributes the hydraulic fluid to each of the hydraulic piston and cylinder arrangements in order to drive the first and second outer cylindrical members either in series or in parallel to provide either continuous or intermittent yet high powered rotational action to the driving member.

The present invention, therefore, provides a new and useful apparatus and method for providing rotational force action to a workpiece.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. An apparatus for applying rotational force to a workpiece, comprising:

a cylindrical driving member having means for engaging said workpiece on which rotational force is to be applied;

a first outer cylindrical member disposed concentrically about said driving member;

means for forcing said driving member to rotate in a first direction in response to rotation of said first outer cylindrical member in said first direction and means for permitting said driving member to slip with respect to said first outer cylindrical member in response to rotation of said first outer cylindrical member in a second direction opposite said first direction;

a second outer cylindrical member disposed concentrically about said driving member;

means for forcing said driving member to rotate in said first direction in response to rotation of said second outer cylindrical member in said first direction and means for permitting said driving member to slip with respect to said second outer cylindrical member in response to rotation of said second outer cylindrical member in said second direction;

means for rotating said outer members in alternating directions to apply a relatively continuous rotational force to said driving member; and means for rotating said outer members in the same direction to apply an intermittent rotational force with increased power to said driving member.

2. An apparatus for applying rotational force to a workpiece in accordance with claim 1, wherein each of said first and said second outer cylindrical members has at least one stud depending therefrom, wherein rotational force is applied to said first and second outer cylindrical members by the action of a hydraulic piston and cylinder arrangement on each of said studs.

3. An apparatus for applying rotational force to a workpiece in accordance with claim 2, wherein each of said hydraulic piston and cylinder arrangements comprises a pair of hydraulic cylinders with a piston disposed within each of said hydraulic cylinders, said pistons being connected through an engagement piece sized to receive one of said outer cylindrical member studs, such that reciprocation of said hydraulic piston and cylinder arrangement causes reciprocation of said stud disposed within said engagement piece, which thereby imparts rotational force to the outer cylindrical member from which said stud depends.

4. An apparatus for applying rotational force to a workpiece in accordance with claim 3, wherein each of said first and second outer cylindrical members has a first and a second stud depending therefrom, disposed approximately 180° from each other along the circumference of said first and second outer cylindrical members, each of said studs having associated therewith a hydraulic piston and cylinder arrangement for the application of reciprocating force thereto.

5. An apparatus for applying rotation force to a workpiece in accordance with claim 3, wherein each of said cylinders and pistons of said hydraulic piston and cylinder arrangements are oval in shape in order to provide greater power than round cylinders and pistons of the same diameters without requiring equivalent space.

6. An apparatus for applying rotational force to a workpiece in accordance with claim 1, wherein said forcing means comprises a ratcheting mechanism between each of said first and second outer cylindrical members and said driving member, said ratcheting mechanism comprising teeth along the inner circumferential surface of each of said first and second outer cylindrical members, and disposing at least one tooth engaging member, comprising an elongate rod having a generally circular cross section with a radial segment removed therefrom, at the outer circumferential surface of said driving member such that rotation of either of said first and second outer cylindrical members in a first direction will cause the teeth disposed on the inner circumferential surface thereof to be engaged by an angular segment of said tooth engaging member to impart rotational force to said driving member, but rotation of either of said first and second outer cylindrical members in a second direction will cause said teeth to slide by said tooth engaging member and not impart rotational force to said driving member.

7. An apparatus for apply rotational force to a workpiece in accordance with claim 6, wherein said tooth engaging member is rotatable on a central shaft thereof to reverse the direction of rotation of either of said first and second outer cylindrical members at which rotational force is imparted to said driving member.

8. An apparatus for applying rotational force to a workpiece in accordance with claim 2, wherein said means for rotating in alternating directions comprises said hydraulic piston and cylinder arrangements such that when said first outer cylindrical member is being driven in said first direction, said second outer cylindrical member is being driven in a second direction, and while said first outer cylindrical member is driven in the second direction, said second outer cylindrical member is being driven in the first direction.

9. An apparatus according to claim 1 wherein said means for forcing said driving member to rotate in a first direction in response to rotation of said first cylindrical member comprises a ratchet mechanism disposed between said first outer cylindrical member and said driving member, said ratchet mechanism engaging when the first outer cylindrical member is rotated said first direction, and slipping when said first outer cylindrical member is rotated in said second direction.

10. An apparatus according to claim 9 wherein said ratchet mechanism comprises teeth on an inner circumferential surface of said first outer cylindrical member, said drive member having an outer surface and at least one tooth engaging member for engaging said teeth when the outer member is rotated in the first direction.

11. An apparatus according to claim 10 wherein said teeth engaging member is reversible to permit the driving member to be rotated in an opposite direction.

12. An apparatus according to claim 9 wherein said ratchet mechanism comprises teeth on an inner circumferential surface of said first outer cylindrical member, said drive member having an outer surface and at least one tooth engaging member for engaging said teeth when the outer member is rotated in the first direction.

13. An apparatus according to claim 12 wherein said teeth engaging member is reversible to permit the driving member to be rotated in an opposite direction.

14. An apparatus according to claim 1 wherein said means for forcing said driving member to rotate in first direction in response to rotation of said second outer cylindrical member comprises a ratchet mechanism disclosed between said second outer cylindrical member and said driving member, said ratchet mechanism engaging when said second outer cylindrical member is rotated in said first direction and slipping when said second outer cylindrical member is rotated in said second direction.

15. An apparatus for applying rotational force to a workpiece, comprising:

a cylindrical driving member having an opening sized to engage a workpiece on which rotational force is to be applied;

a first outer cylindrical member disposed concentrically about said driving member;

means for forcing said driving member to rotate in a first direction in response to rotation of said first outer cylindrical member in said first direction and means for permitting said driving member to slip with respect to said first outer cylindrical member in response to rotation of said first outer cylindrical member in a second direction opposite said first direction;

a second outer cylindrical member disposed concentrically about said driving member;

means for forcing said driving member to rotate in said first direction in response to rotation of said second outer cylindrical member in said first direction and means for permitting said driving member to slip with respect to said second outer cylindrical member in response to rotation of said second outer cylindrical member in said second direction;

at least on hydraulic piston and cylinder arrangement in operative connection with each of said first and second outer cylindrical members to drivingly rotate them in either of a first or a second direction in series to apply relatively continuous rotational force to said driving member or in parallel to apply intermittent force to said driving member, wherein each of the pistons and cylinders in said hydraulic piston and cylinder arrangements is oval in shape.

16. An apparatus for applying rotational force to a workpiece, in accordance with claim 15, wherein each of said first and said second outer cylindrical members have two hydraulic piston and cylinder arrangements in operative connection therewith.

17. An apparatus for applying rotational force to a workpiece, in accordance with claim 16, wherein the hydraulic piston and cylinder arrangements for said first and said second outer cylindrical members are stacked side by side.

18. An apparatus for applying rotational force to a workpiece, comprising:

a cylindrical driving member having an opening sized to engage a workpiece on which rotational force is to be applied;

a first outer cylindrical member disposed concentrically about said driving member;

means for forcing said driving member to rotate in a first direction in response to rotation of said first outer cylindrical member in said first direction and means for permitting said driving member to slip with respect to said first outer cylindrical member in response to rotation of said first outer cylindrical member in a second direction opposite said first direction;

a second outer cylindrical member disposed concentrically about said driving member;

means for forcing said driving member to rotate in said first direction in response to rotation of said second outer cylindrical member in said first direction and means for permitting said driving member to slip with respect to said second outer cylindrical member in response to rotation of said second outer cylindrical member in said second direction;

at least one hydraulic piston and cylinder arrangement in operative connection with each of said first and said second outer cylindrical members to drivingly rotate them in either of a first or a second direction;

a coaxial valving system for controlling the flow of hydraulic fluid to said hydraulic piston and cylinder arrangements, which comprises an inner disk having a series of ports connected by passageways for the flow of hydraulic fluid;

an outer disk concentrically disposed about said inner disk, having a series of ports connected by passageways for the flow of hydraulic fluid; and a manifold disposed abutting said inner disk and said outer disk, having a series of ports connected by passageways for the flow of hydraulic fluid, said manifold having a first and a second port disposed on a first side thereof in operative fluid connection with said arrangement and a third and a fourth port disposed on a second side thereof in operative fluid connection with said arrangement, wherein said rotation of said inner disk and said outer disk with respect to each other will cause alignment of said inner disk ports and said outer disk ports through said manifold ports to control the flow of hydraulic fluid through said inner disk passageways and said outer disk passageways such that the flow of hydraulic fluid from said manifold to said hydraulic piston and cylinder arrangements can be controllably varied.

19. An apparatus according to claim 18 wherein said manifold of said coaxial valving system includes a fifth port for receiving a supply of hydraulic fluid and a sixth port for removing hydraulic fluid from said valving system, said series of ports of said outer disk being alignable with said six ports of said manifold, said passageways of said outer disk being three in number and connecting three spaced apart pairs of ports, said outer disk being rotatable with respect to said manifold to a first position wherein the ports of the manifold are out of alignment with the ports of said outer disk to block flow of fluid to a second position wherein the ports of said outer disk are in alignment with the ports of the manifold to permit flow of fluid out of said first and fourth port and flow of fluid into said second and third ports, said outer disk being rotatable with respect to said manifold to a third position wherein the ports of said outer disk are in alignment with said ports of said manifold such that hydraulic fluid is directed out of said second and third ports and is received by said first and fourth ports.

20. An apparatus according to claim 19 wherein said first outer cylindrical member has a piston and cylinder arrangement for rotating said first outer member and another piston and cylinder arrangement for rotating said second outer member, each said piston and cylinder arrangement having a segment on either side of the piston for receiving hydraulic fluid, said first port of said manifold being connected with one cylinder segment of the piston cylinder and cylinder that drives the first outer cylindrical member, said third port of said manifold being connected with a second cylinder segment of the piston and cylinder arrangement that drives the first outer cylindrical member, said second port of said manifold being connected to one segment of said piston and cylinder arrangement that drives said second outer drive member, said fourth port of said manifold being connected with a second cylinder segment of said piston and cylinder arrangement that drive said second outer drive member, said outer disk in a first position terminating flow of fluid to said piston and cylinder arrangement to cease movement of said first and second outer cylindrical members, said rotation of said outer disk to said second position causing said first outer member to rotate in said first direction and said second outer member to rotate in said second direction, said movement of said outer disk to said third position causing said first outer cylindrical member to move in said second direction and said second outer cylindrical member to move in said first direction thereby causing said first and second outer cylindrical members to rotate alternately.

21. An apparatus according to claim 18 wherein said inner disk includes a series of ports, said inner disk rotatable from a first position wherein flow of hydraulic fluid is blocked and said hydraulic piston and cylinders arrangements are not operating to a second position wherein hydraulic fluid is directed out of said first and second ports of the manifold and received by said third and fourth ports of said manifold, and said inner disk rotatable to a third position wherein hydraulic fluid is directed into said first and second ports of said manifold and out of said third and fourth ports of said manifold thereby moving the first and second outer cylindrical members in the same direction.

22. An apparatus for applying rotational force to a workpiece comprising:

a cylindrical driving member having means for engaging said workpiece on which rotational force is to be applied;

a first member for imparting rotational force to said cylindrical driving member;

a second member for imparting rotational force to said driving member;

means for forcing said driving member to rotate in a first direction in response to movement of said first member in a first direction and means for permitting said driving member to slip with respect to said first member in response to movement of said first member in a second direction opposite said first direction;

means for forcing said driving member to rotate in said first direction in response to movement of said second member in said first direction and means for permitting said driving to slip with respect to said second member in response to movement of said second member in said second direction;

means for moving said first and second members in alternating directions to apply a relatively continuous rotational force to said driving member; and means for moving said members in the same direction to apply intermittent rotational force with increased power to said driving member.

23. An apparatus according to claim 22 wherein said means for forcing said driving member to rotate in response to movement of said first member comprises a ratchet mechanism located between said driving member and said first member, said ratchet mechanism engaging when said first member is moved in said first direction and slipping when said first member is moved in said second direction.

24. An apparatus according to claim 23 wherein said means for forcing said driving member to rotate in response to movement of said second member comprises a ratchet mechanism located between said driving member and said second member, said ratchet mechanism engaging when said second member is moved in said first direction and slipping when said second member is moved in said second direction.

* * * * *